United States Patent [19]

Tomar

[11] 4,364,565

[45] Dec. 21, 1982

[54] GAME BALL

[75] Inventor: Julius Tomar, Port-au-Prince, Haiti

[73] Assignee: Home of Champions, S.A., Port-au-Prince, Haiti

[21] Appl. No.: 287,471

[22] Filed: Jul. 31, 1981

Related U.S. Application Data

[63] Continuation-in-part of Ser. No. 266,326, May 22, 1981, abandoned.

[51] Int. Cl.[3] ..... A63B 37/00; A63B 37/02

[52] U.S. Cl. ..... 273/60 R; 521/144; 521/149

[58] Field of Search ..... 273/60 R; 521/81, 139, 521/143, 144, 149, 150, 155

[56] References Cited

U.S. PATENT DOCUMENTS

| | | | |
|---|---|---|---|
| 3,976,295 | 8/1976 | Heald, Jr. | 273/60 R |
| 4,102,829 | 7/1978 | Watanabe et al. | 521/81 |
| 4,144,297 | 3/1979 | Tomar | 273/60 R |
| 4,149,720 | 4/1979 | Heald, Jr. | 273/60 R |
| 4,274,637 | 6/1981 | Molitor | 521/143 |

*Primary Examiner*—Allan Lieberman

*Attorney, Agent, or Firm*—Webb, Burden, Robinson & Webb

[57] ABSTRACT

A game ball is comprised of a single spherical core and a cover. The core is comprised of a single spherical mass of partially blown copolymer of ethylene and at least one unsaturated monocarboxylic acid having from 3 to 8 carbon atoms. The copolymer contains up to 30 percent by weight of the acid copolymerized therein with foam at the center of the core and having a skin with the density substantially equal to the density of the copolymer. The game balls are baseballs and softballs.

5 Claims, No Drawings

GAME BALL

CROSS REFERENCE TO RELATED APPLICATIONS

This application is a continuation-in-part of copending U.S. application Ser. No. 266,326, filed May 22, 1981 and now abandoned.

BACKGROUND OF THE INVENTION

1. Field of the Invention

This invention relates to game balls and more particulary to baseballs and softballs having a thermoplastic core.

2. Description of the Prior Art

Softballs such as are used in both slo-pitch and fast-pitch softball leagues are manufactured in various dimensions with a vast range of physical properties. One common design uses a cork or kapok core wound with synthetic yarn or thread with a cover formed upon the surface of the softball. Typically, the covers are comprised of two pieces which are stitched together. The material of construction for the covers can be either leather, plastic, vinyl or the like. In addition, practice softballs have been manufactured having a core such as previously described with a molded rubber cover to enhance durability. Consequently, the density of the softball along with its attendant properties is determined by its materials of construction and by how tightly the ball is wound. Therefore, there are variables in softball manufacturing which are not capable of adequate control and softball manufacturers have endeavored to find materials of construction sufficient to provide consistency to their product.

Baseballs, as are used in the United States by professional leagues and little leagues, are formed of a cork or rubber core wound with wool yarn and cotton thread, and covered with a stitched, two-piece leather cover. In some instances the cover may be vinyl or rubber, especially in the little leagues where the durability of practice balls is essential. Consequently, the density of the baseball along with its attendant properties is determined by its materials of construction and by how tightly the wool yarn is wound. Therefore, there are variables in baseball manufacturing which are not capable of adequate control and baseball manufacturers have endeavored to find materials of construction sufficient to provide consistency to their product.

In addition, a major factor in the production of softballs and baseballs is the cost of winding cores which involves substantial labor or investment in winding machines.

Confronted with the problem of a uniform product along with increasing labor and capital costs, softball and baseball manufacturers have endeavored to form ball cores of plastic material to solve these problems. Exemplary of such efforts are the teachings of U.S. Pat. No. 3,976,295 and Canadian Pat. No. 632,220. However, as in any sport, participants therein and distributors of such equipment are reluctant to change from existing equipment, and therefore, balls intended to replace the conventional softball and baseball have not received widespread acceptance.

However, in U.S. Pat. No. 4,211,407, a method of forming softballs and baseballs of a single spherical core along with the balls themselves is disclosed wherein such softballs and baseballs have essentially the same characteristics as conventional softballs and baseballs.

Although the softballs produced in accordance with U.S. Pat. No. 4,211,407 are more durable than the conventional softballs, upon prolonged hitting, these softballs, in some instances, develop flat spots. This is a particular problem with respect to softballs which are used in fast-pitch leagues where the striking force on the ball is compounded by the speed at which the ball is pitched.

There are two general types of softballs, one used in fast-pitch and one used in slo-pitch. The slo-pitch balls are referred to as restricted flight balls since they are designed to have less rebound than fast-pitch balls.

In addition, the baseballs produced in accordance with U.S. Pat. No. 4,211,407 have received acceptance, however, they are improved in accordance with the present invention.

In accordance with the present invention, softballs are provided which have excellent playing characteristics which are essentially the same as conventional softballs and additionally have substantially improved durability and do not develop flat spots on prolonged hitting.

Further, baseballs in accordance with the present invention exhibit excellent durability and playing characteristics.

BRIEF DESCRIPTION OF THE INVENTION

A game ball is comprised of a single spherical core and a cover. The core is comprised of a single spherical mass of partially blown copolymer of ethylene and at least one unsaturated monocarboxylic acid having from 3 to 8 carbon atoms. The copolymer contains up to 30 percent by weight of the acid copolymerized therein with foam at the center of the core and having a skin with a density substantially equal to the density of the copolymer.

DETAILED DESCRIPTION OF THE INVENTION

The copolymers necessary in providing the softballs and baseballs of the invention are copolymers of at least one olefin with at least one unsaturated carboxylic acid and can be either random copolymers in which the molecular chains are composed of the different monomers polymerized and can be graft copolymers made by polymerizing the unsaturated carboxylic acid monomer onto a backbone molecular chain of the polyolefin. The graft copolymers can be prepared by irradiation, e.g. gamma or ultraviolet radiation of the mixture of polyolefin and the unsaturated carboxylic acid. The copolymer may, if desired, contain small amounts, e.g. less than 10 percent by weight of other monomers such as vinyl alkanoic esters, alkyl acrylates and alkyl methacrylates.

Preferably, the olefin contains a small number of carbon atoms in the molecule and a particularly useful copolymer is prepared from ethylene. The unsaturated carboxylic acid can be dicarboxylic acid but preferably is a mono-carboxylic acid, for example, acrylic acid, methacrylic acid, itaconic acid, crotonic acid and sorbic acid. Mixtures of different carboxylic acids can be used and metal salts of the acid in which the metal has a valency of from 1 to 4, e.g. sodium or zinc salts, can be used to form terpolymers with the olefin and a free acid. A typical polymer is a terpolymer of ethylene, methacrylic acid and sodium methacrylate.

The copolymers can contain up to 30 percent by weight of the unsaturated carboxylic acid but preferably contain up to 15 percent by weight. If a metal salt of an acid is used, the metal is usually present in an amount of from 10 to 75 percent, preferably 15 to 60 percent and particularly 20 to 50 percent of the stoichiometric equivalent of the carboxylic acid. The copolymers are thermoplastic and have a lower softening point than homopolymers of the olefin.

Preferably, the copolymers contain a number of thermolabile crosslinkages to increase the hardness and stiffness of the polymer produced. This can be achieved by employing a terpolymer with a metal salt of the acid as described above, and/or a crosslinking agent can be introduced into the composition immediately prior to the formation of the softball. For example, a metal salt can be reacted with the copolymer. The composition containing the thermolabile crosslinkages remains thermoplastic although the viscosity of the molten composition is greater than that of a composition which does not contain the thermolabile crosslinkages. The crosslinked composition has an increased hardness and toughness as compared to a noncrosslinked composition.

The crosslinking agent used to introduce the thermolabile crosslinkages into the copolymer composition is an inorganic or organic metal compound that allows the metal ions to become associated with the reactive carboxyl groups in the polymer and typical metal compounds are the acetates, oxides, carbonates and hydroxides. Preferably, mono- or divalent metal compounds are used, and examples of suitable compounds are the acetates or sodium and potassium, or the oxides of calcium, magnesium and zinc. Compounds of trivalent and tetravalent metals such as aluminum or lead may also be used.

The amount of crosslinking agent that is mixed with the copolymer is less than that theoretically required to react with all the acid groups in the copolymer and usually is less than 75 percent of stoichiometric equivalent of the carboxylic acid. Preferably, 15 to 60 percent, particularly 20 to 50 percent, of the stoichiometric equivalent of the carboxylic acid is used.

In addition to the copolymer of the olefin and the unsaturated carboxylic acid, other thermoplastic polymers may be compounded therewith to form the softballs of the invention. However, it is preferable that the softballs have therein at least 60 percent by weight of the copolymer of the olefin and unsaturated carboxylic acid and more preferably at least 75 precent by weight. In the case of baseballs, it is preferable that there be at least 5 percent by weight and more preferably at least 10 percent by weight of the copolymer of the olefin and unsaturated carboxylic acid.

The thermoplastic resins useful in addition to the copolymer of the olefin and unsaturated carboxylic acid are polymers and copolymers of olefinically unsaturated compounds and their derivatives such as ethylene vinyl acetate copolymers, polyethylene, polypropylene, styrene, vinyl resin, nylons, polycarbonates, thermoplastic polyurethanes, polyhydroxy ethers, thermoplastic phenolics and the like. Most preferably, an ethylene vinyl acetate copolymer has been found to be useful, particularly ethylene vinyl acetate copolymers having polymerized vinyl acetate contents of 12 percent to 30 percent and most preferably 18 percent to 25 percent. The criteria for the incorporation of the thermoplastic resins are the rebound of the softballs and baseballs along with their durability upon repeated striking. The blowing agents useful in the practice of the invention to form the game ball cores can be a heat decomposable compound, a gas or a liquid which is volatile under molding conditions.

Exemplary of the heat decomposable blowing agents are; azo-N-nitroso carbonate, sulfonyl hydrazide, and azodicarbonamide. Upon decomposition, these compounds yield a gas such as carbon dioxide or nitrogen. The gases which may be employed as a blowing agent are typically methylchloride, propylene, butylene and gaseous fluorcarbons. Liquid blowing agents such as water and liquid fluorcarbon blowing agents known to those skilled in the art can also be employed to foam the copolymer or copolymer blends.

The heat decomposable blowing agents are preferred in the practice of the invention and are used in the range of 0.06 percent to 1 percent by weight and preferably 0.12 percent to 0.6 percent by weight. Typically, the blowing agent level for the softballs of the invention is 0.48 percent to 0.72 percent by weight based on the total weight of thermoplastic material.

A parameter which must be considered when selecting a blowing agent, is its decomposition or activation temperature in relation with the rheological properties of the polymer. Thus, for example, diazoaminobenzene can be employed which activates and decomposes at 95° to 105° C. while azodicarbonamide can be employed at activation and decomposition at the temperature range of 160° to 200° C. Although the blowing agents are operationally activated at relatively discrete temperatures, the broader activation range is provided by the addition of an activator which reduces the activation temperature. A typical activator is zinc oxide which may be employed at levels of 0.1 percent to 0.2 percent based on the weight of the blowing agent. In addition, higher levels of zinc oxide or other metal oxides can be used when they are used as crosslinking agents for the mono-olefin unsaturated carboxylic acid polymer.

Activation when used in relation to the nonheat decomposable blowing agents means the temperature and pressure conditions at which the blowing agent forms a gas.

In actual practice, the blowing agent is homogeneously mixed with the copolymer of the mono-olefin and unsaturated carboxylic acid and other thermoplastic resin if desired. The copolymer and thermoplastic resin are in particulate form and are mixed by tumble blending at ambient temperature. The particulate mixture is mixed under temperature and pressure conditions suitable to homogenize the mixture and form a dispersion or solution of the blowing agent in the resin and additionally to form a homogeneous particulate mixture of the resinous components if they are, in fact, different. The dispersion or solution is extruded and cut into pellets or ground into powder form. The extruded material is often called a masterbatch. The blowing agent is incorporated into the resin used in the final softball by tumble blending the particulate thermoplastic material with the masterbatch. Typically, a masterbatch yielding 30 to 50 mls/gram and preferably 35 to 45 mls/gram of gas at standard temperature and pressure is desired. Consequently, the masterbatch is used at a range of 1 to 6 percent by weight based on the weight of the total resin and preferably 4.5 to 5.5 percent for softballs and 1 to 2 percent for baseballs.

The process of forming the softballs and baseballs is practiced in a conventional injection molding machine.

The resinous components in particulate form are tumble blended with the masterbatch until homogeneous. The blend is charged to the hopper of an injection molding machine which melts the resin under heat and pressure converting it to a flowable thermoplastic mass. Preferably, the mono-olefin and unsaturated carboxylic acid and crosslinking agent (and other thermoplastic resin, if desired) is used, the feed temperature is at about 200° to 220° C., and the extruder barrel temperature of 230° to 250° C. and a nozzle temperature of 240° to 260° C.

The nozzle of the injection molding machine is in liquid flow communication with a mold whose mold cavity or cavities is of substantially the same dimension as the final softball or baseball cores. The molds are water cooled to a temperature of 32° to 65° F. and preferably 35° to 45° F. which is necessary to form a skin on the surface of the thermoplastic mass injected into the mold. Upon injection of the required amount of thermoplastic material into the mold cavity, the mold is continuously cooled with water to maintain the mold cavity surface at the low temperature. The thermoplastic mass is held in the mold for 4 to 6 minutes and more preferably, from 4½ to 5 minutes in order that the thermoplastic mass form a skin of adequate strength so that upon removal of the mass from the mold, the blowing agent contained within the mass does not rupture the skin. When the thermoplastic mass is removed from the mold before it has been within the mold for the prescribed time, the blowing agent ruptures the skin and molten resin exudes from the interior of the ball. The upper limit of residence time within the mold is a matter of economics since the thermoplastic mass may be held within the mold for an indefinite period of time. However, since production speed and reuse of the mold is desirable, economic residence duration is defined as the upper limit. Upon removal of the mass from the mold, the sprue is cut with a small excess above the surface of the sphere to allow for shrinkage, and the formed ball core is placed in a water immersion bath at 32° to 65° F., and more preferably, 35° to 45° F. Initially the ball core expands due to the internal pressure of the blowing agent, in the case of softballs to 11-11/16 inches to 11-13/16 inches in circumference and shrinks to its original size of 11-9/16 inches while in the water bath. The minimum period of quenching time in the water bath is about 15 minutes. If the ball core is not sufficiently cooled in the water, it does not shrink and an oversize product is obtained. After removal from the water bath, the balls are placed on a rack at ambient temperature. The sprue is removed by sanding or a like process and the ball core is ready to be covered.

The softballs and baseballs, as formed from the above process, have dimensions substantially the same as the mold cavity. The balls can be produced with tolerances of ±0.1 percent deviation in circumference and ±0.6 percent deviation in weight.

The interior of the softballs and baseballs has been examined by cross sections thereof and is characterized by foam in the center of the core with a gradual reduction in cell size extending radially outwardly to the skin which has a density substantially equal to the density of the copolymer, or mixture of copolymers, used in the molding operation. The skin constitutes about 3 to 15 percent of the spherical radius of the core and more preferably 8 to 12 percent.

The following Examples are not intended to limit the invention, but are by way of illustration.

EXAMPLE I

One hundred parts of a particulate ethylene acrylic acid copolymer ionomer having acrylic acid copolymerized therein and sold under the trade name Surlyn 1652 was tumble blended with 4.5 parts of a blowing agent having an activation temperature of 170° C. and evolving 40 mls of gas at standard temperature and pressure.

The Surlyn 1625 had the following properties:

| | |
|---|---|
| Zinc cation | |
| Melt flow index gms/10 min | 5.0 |
| Specific gravity | 0.94 |
| Area yield, $m^2$/kg @ .25 mm | 4.2 |
| Tensile Impact @ 23° C. kJ/$m^2$ | 925 |
| Tensile Impact @ −40° C. kJ/$m^2$ | 560 |
| Tensile Strength, MPa | 21.4 |
| Elongation % | 500 |

The tumble blended mixture was charged to a screw and ram injection molding machine having a feed temperature of 220° C. a barrel temperature of 250° C. and a nozzle temperature of 260° C. The total extrusion time was about 4 to 6 seconds with a total residence time of about 20 seconds. The molten resinous mass was injected from the nozzle into the cavity of a mold which is chilled by a circulatory water cooling at 44° F.; the mold cavity has three separate spherical sectors, each about 11-9/16 inches and are connected by a channel leading to the exterior of the mold. The channel is in liquid flow communication with the nozzle of the injection molding machine during injection of the resinous mass.

Upon injection of the thermoplastic flowable mass into the mold cavity, the resultant gas expands and foams the thermoplastic flowable mass to fill the mold cavity. The thermoplastic mass was held in the mold for about 5 minutes and removed. Upon removal the molded resin was in the form of three softball cores connected by the sprue formed within the channel. The sprue was cut allowing a slight excess to remain above the sphere. The individual balls were placed in a water bath maintained at 42° to 46° F. for 15 minutes. During cooling the cores expanded to about 11-13/16 inches and shrunk to 11-9/16 inches. The ball cores were removed from the water bath and stored at ambient temperature for 24 hours. The balls have a skin thickness of about 1/8 inch. The sprue was ground off with a grinding wheel and a two-piece leather cover was sewn on the cores to produce softballs. The softballs so formed had a 72 inch rebound from a 20 foot drop thus making them particularly useful for slo-pitch softball. After repeated striking of the softballs by bat testing, they did not develop flat spots and retained their rebound characteristics.

EXAMPLE II

Example I was repeated except that the thermoplastic mass was 75 percent of an ethylene-carboxylic acid copolymer ionomer sold under the trade name Surlyn 1559 and 25 percent ethylene vinyl acetate copolymer sold under the trade name Elvax 660.

The Surlyn 1559 had the following properties:

| | |
|---|---|
| Sodium cation | |
| Melt flow index gms/10 min | 1.0 |
| Specific gravity | 0.94 |

-continued

| | |
|---|---|
| Area yield, $m^2/kg$ @ .25 mm | 4.2 |
| Tensile Impact @ 23° C. $kJ/m^2$ | 1160 |
| Tensile Impact @ −40° C. $kJ/m^2$ | 935 |
| Tensile Strength MPa | 29.0 |
| Elongation % | 450 |

The Elvax 660 was an ethylene and vinyl acetate copolymer having percent vinyl acetate of 12.0 and a melt index of 2.5. The softballs produced in accordance with Example II had a rebound of 100 inches from a 20 foot drop thus making them particularly useful for fast-pitch softball. After repeated striking of the softballs by bat testing, they did not develop flat spots and retained their rebound characteristics.

EXAMPLE III

Ninety parts of a particulate ethylene acrylic acid copolymer having acrylic acid copolymerized therein and sold under the trade name Surlyn 1652 was tumble blended with ten parts of a particulate ethylene vinyl acetate copolymer having 12 percent vinyl acetate polymerized therein with 1.37 parts of a blowing agent having an activation temperature of 170° C. evolving 40 mls of gas at standard temperature and pressure. The tumble blended mixture was charged to a screw and ram injection molding machine having a feed temperature of 220° C. a barrel temperature of 250° C. and a nozzle temperature of 260° C. The total extrusion time was about 4 to 6 seconds with a total residence time of about 20 seconds. Nineteen ounces of the molten resinous mass was injected from the nozzle into the cavity of a mold which is chilled by a circulatory water cooling at 44° F.; the mold cavity has four separate spherical sectors, each about 8-13/16 inches and are connected by a channel leading to the exterior of the mold. The channel is in liquid flow communication with the nozzle of the injection molding machine during injection of the resinous mass.

Upon injection of the thermoplastic flowable mass into the mold cavity, the resultant gas expands and foams the thermoplastic flowable mass to fill the mold cavity. The thermoplastic mass was held in the mold for about 5 minutes and removed. Upon removal the molded resin was in the form of four unitary baseball cores connected by the sprue formed within the channel. The sprue was cut allowing a slight excess to remain above the sphere. The individual cores were placed in a water bath maintained at 42° to 46° F. for 15 minutes. During cooling the cores expanded to about 9 inches and shrunk to $8\frac{3}{4}$ inches. The cores were removed from the water bath and stored at ambient temperature for 24 hours. The cores had a skin thickness of about $\frac{1}{8}$ inch. The sprue was ground off with a grinding wheel and the core so formed was covered with a two-piece leather cover. The baseball so formed had excellent playing characteristics and durability.

Although the invention has been described with reference to specific materials and specific conditions, the invention is only to be limited insofar as is set forth in the accompanying claims.

I claim:

1. In a game ball comprised of a spherical core and a cover, the improvement wherein said core is comprised of a partially blown single spherical mass of at least 10 percent by weight of a copolymer of ethylene and at least one unsaturated monocarboxylic acid having from 3 to 8 carbon atoms, said copolymer containing up to 30 percent by weight of said acid copolymerized therein with foam at the center of said core and having a skin with a density substantially equal to the density of said copolymer, said copolymer being crosslinked with thermolabile crosslinkages.

2. The game ball of claim 1 wherein said spherical mass includes a copolymer of ethylene and vinyl acetate.

3. The game ball of claim 1 which is a softball and wherein said spherical mass has at least 60 percent by weight of said copolymer of ethylene and unsaturated monocarboxylic acid.

4. The softball of claim 3 wherein said spherical mass has therein at least 75 percent by weight of said copolymer of ethylene and said unsaturated monocarboxylic acid.

5. The softball of claim 4 consisting essentially of said copolymer of ethylene and at least one unsaturated monocarboxylic and, said softball being a restricted flight softball.

* * * * *

UNITED STATES PATENT AND TRADEMARK OFFICE

CERTIFICATE OF CORRECTION

PATENT NO. : 4,364,565

DATED : December 21, 1982

INVENTOR(S) : Julius Tomar

It is certified that error appears in the above-indentified patent and that said Letters Patent is hereby corrected as shown below:

Column 3, line 59, "resin" should read —resins—.

Column 6, line 10, "1625" should read —1652—.

Signed and Sealed this

Fourth Day of October, 1994

*Attest:*

*Attesting Officer*

BRUCE LEHMAN

*Commissioner of Patents and Trademarks*